US009672973B2

(12) United States Patent
Fukuzawa et al.

(10) Patent No.: US 9,672,973 B2
(45) Date of Patent: Jun. 6, 2017

(54) WIRELESS POWER TRANSMISSION DEVICE

(71) Applicant: TDK CORPORATION, Tokyo (JP)

(72) Inventors: Narutoshi Fukuzawa, Tokyo (JP); Mitsunari Suzuki, Tokyo (JP); Akihiro Il, Tokyo (JP); Hiroshi Saiwai, Tokyo (JP)

(73) Assignee: TDK CORPORATION, Tokyo (JP)

( * ) Notice: Subject to any disclaimer, the term of this patent is extended or adjusted under 35 U.S.C. 154(b) by 381 days.

(21) Appl. No.: 14/306,659

(22) Filed: Jun. 17, 2014

(65) Prior Publication Data

US 2015/0001953 A1 Jan. 1, 2015

(30) Foreign Application Priority Data

Jun. 27, 2013 (JP) ..... 2013-135000

(51) Int. Cl.
*H01F 27/42* (2006.01)
*H01F 27/36* (2006.01)
*H01F 38/14* (2006.01)

(52) U.S. Cl.
CPC ..... *H01F 27/36* (2013.01); *H01F 38/14* (2013.01)

(58) Field of Classification Search
CPC ..... H01F 38/14; H01F 27/36
USPC ..... 307/104
See application file for complete search history.

(56) References Cited

U.S. PATENT DOCUMENTS

2013/0113297 A1* 5/2013 Miyamoto ..... H02J 7/025 307/104
2015/0008877 A1* 1/2015 Ichikawa ..... H01F 27/362 320/108
2015/0137590 A1* 5/2015 Ichikawa ..... H01F 38/14 307/9.1
2016/0056664 A1* 2/2016 Partovi ..... H02J 7/025 307/104

FOREIGN PATENT DOCUMENTS

JP A-2006-42519 2/2006
JP 2008-087733 A 4/2008
JP 2010-093180 A 4/2010
JP 2012-239360 A 12/2012
WO 2013/038591 A1 3/2013

* cited by examiner

*Primary Examiner* — Jared Fureman
*Assistant Examiner* — Duc M Pham
(74) *Attorney, Agent, or Firm* — Oliff PLC

(57) ABSTRACT

A wireless power transmission device includes a power feeding unit and a power receiving unit. The power feeding unit and the power receiving unit are disposed so that a principal surface of a primary magnetic core and a principal surface of a secondary magnetic core face each other across a primary winding and a secondary winding. The distance from a surface of a feeding-side shield member which faces a feeding-side coil to a surface of the feeding-side coil which faces the feeding-side shield member, is longer than the distance from a surface of a receiving-side shield member which faces a receiving-side coil to a surface of the receiving-side coil which faces the receiving-side shield member.

3 Claims, 2 Drawing Sheets

WIRELESS POWER TRANSMISSION DEVICE

BACKGROUND

The present invention relates to a wireless power transmission device.

DESCRIPTION OF THE RELATED ART

A Power feeding technology which supplies power without using a power cord, that is, a so-called wireless power feeding technology has attracted attention. Since the wireless power feeding technology is able to supply power from a power feeding equipment to a power receiving equipment in a non-contact manner, it is expected to be applied to various products such as transportation equipment including electric trains and electric vehicles, household appliances, electronic equipment, wireless communication equipment, and toys.

Devices used for wirelessly feeding power do not employ a system in which electricity flows from a feeding equipment side circuit to a receiving equipment side circuit by means of physical contact. Therefore, it is of vital importance for these devices to reduce the loss that occurs when transmitting electric power from the feeding equipment side circuit and the receiving equipment side circuit to enable efficient power transmission.

With a view to achieving efficient power transmission, Japanese Unexamined Patent Application Publication No. 2006-42519 discloses a non-contact power transmission device described below. In the non-contact power transmission device, a first coil and a second coil that are electromagnetically coupled to each other are respectively a first planar coil and a second planar coil that have a spiral shape, with their planes facing each other. Each of the first planar coil and the second planar coil has a magnetic sheet provided on a surface located opposite to the surface facing the other planar coil.

However, the present inventors have found as a result of diligent research that the non-contact power transmission device described in Japanese Unexamined Patent Application Publication No. 2006-42519 does not provide sufficient power transmission efficiency.

On the side of the equipment that receives supply of electric power, for example, transportation equipment such as an electronic vehicle, it is of vital practical importance to reduce unnecessary radiation to the surroundings and an electromagnetic influence from the surroundings.

SUMMARY

Accordingly, it is an object of the present invention to provide a wireless power transmission device which makes it possible to improve the Q factor in the power feeding unit that leads to an improvement in power transmission efficiency, and reduce unnecessary radiation to the surroundings and an electromagnetic influence from the surroundings.

Accordingly, the present invention provides a wireless power transmission device, including: a power feeding unit, the power feeding unit including a feeding-side coil having a primary winding and a primary magnetic core, the primary magnetic core having two principal surfaces that face each other, and a feeding-side shield member having two principal surfaces that face each other, one of the principal surfaces of the primary magnetic core and one of the principal surfaces of the feeding-side shield member being disposed so as to face each other; and a power receiving unit, the power receiving unit including a receiving-side coil having a secondary winding and a secondary magnetic core, the secondary magnetic core having two principal surfaces that face each other, and a receiving-side shield member that has two principal surfaces that face each other, one of the principal surfaces of the secondary magnetic core and one of the principal surfaces of the receiving-side shield member being disposed so as to face each other, the receiving-side coil and the receiving-side shield member being disposed so as to overlap each other. The power feeding unit and the power receiving unit are disposed so that another one of the principal surfaces of the primary magnetic core and another one of the principal surfaces of the secondary magnetic core face each other across the primary winding and the secondary winding. The distance from a surface of the feeding-side shield member which faces the feeding-side coil to a surface of the feeding-side coil which faces the feeding-side shield member, is longer than the distance from a surface of the receiving-side shield member which faces the receiving-side coil to a surface of the receiving-side coil which faces the receiving-side shield member.

In the wireless power transmission device according to the present invention, the distance from a surface of the feeding-side shield member which faces the feeding-side coil to a surface of the feeding-side coil which faces the feeding-side shield member is longer than the distance from a surface of the receiving-side shield member which faces the receiving-side coil to a surface of the receiving-side coil which faces the receiving-side shield member. As a result, the Q factor in the power feeding unit improves. Since power transmission efficiency is the product of a coupling coefficient k and a Q factor, the Q factor is an important factor for improving power transmission efficiency. Therefore, an improvement in Q factor leads to an improvement in power transmission efficiency. Further, because the receiving-side coil and the receiving-side shield member are disposed so as to overlap each other in the power receiving unit, unnecessary radiation to the surroundings and an electromagnetic influence from the surroundings can be reduced. Therefore, the present invention can provide a wireless power transmission device that makes it possible to both improve the Q factor in the power feeding unit which leads to an improvement in power transmission efficiency, and reduce unnecessary radiation to the surroundings and an electromagnetic influence from the surroundings.

In the wireless power transmission device according to the present invention, the primary winding is a wire that is wound in a planar shape, and provided on one of the principal surfaces of the primary magnetic core which is located opposite to one of the principal surfaces of the primary magnetic core which faces the feeding-side shield member, and the secondary winding is a wire that is wound in a planar shape, and provided on one of the principal surfaces of the secondary magnetic core which is located opposite to one of the principal surfaces of the secondary magnetic core which faces the receiving-side shield member. The above-mentioned structures of the primary winding and secondary winding ensure that the above-mentioned effect is achieved more reliably.

In the wireless power transmission device according to the present invention, the primary winding is a wire that is wound around the primary magnetic core in a helical shape while crossing the two principal surfaces of the primary magnetic core a plurality of times, and the secondary winding is a wire that is wound around the secondary magnetic core in a helical shape while crossing the two principal surfaces of the secondary magnetic core a plurality of times. The above-mentioned structures of the primary winding and secondary winding ensure that the above-mentioned effect is achieved more reliably.

DETAILED DESCRIPTION OF EMBODIMENTS

Figure 1:
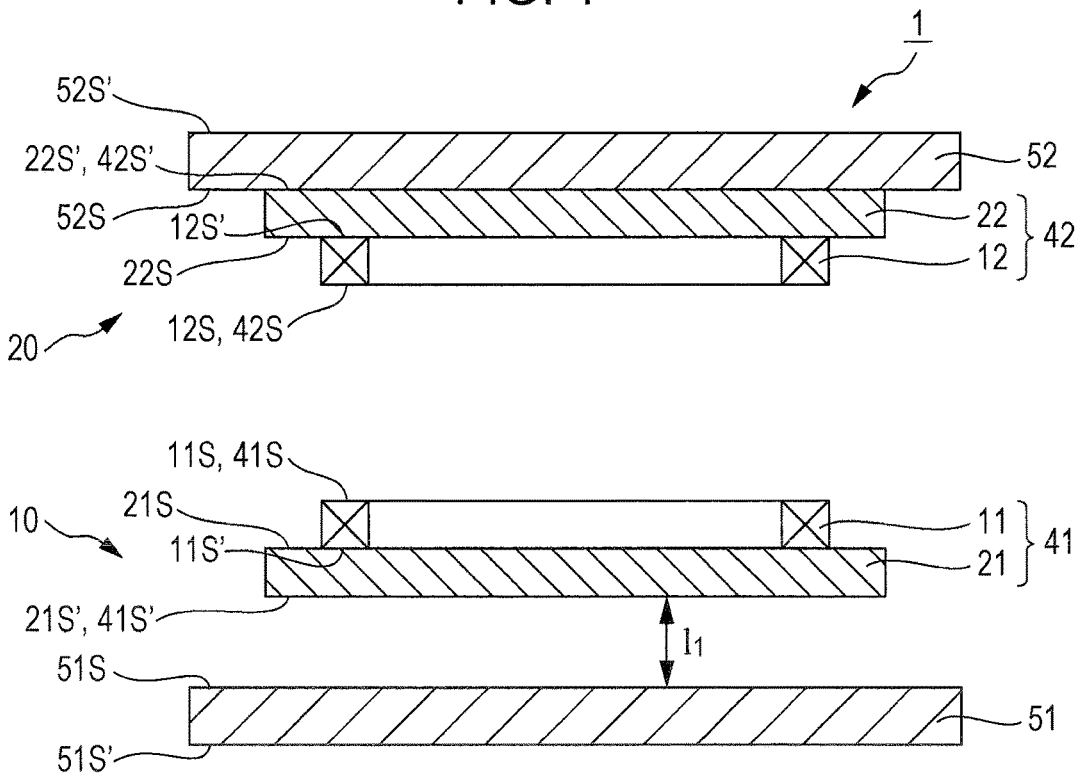
FIG. 1 is a cross-sectional view of a wireless power transmission device according to a first embodiment of the present invention.

Hereinafter, preferred embodiments of the present invention will be described with reference to the drawings. It is to be understood, however, that the present invention is not limited to the embodiments described below. In the following description, portions that are identical or equivalent to each other will be denoted by the same reference numerals, and thus the redundant description thereof will be omitted.

The present invention provides a wireless power transmission device, including: a power feeding unit, the power feeding unit including a feeding-side coil having a primary winding and a primary magnetic core, the primary magnetic core having two principal surfaces that face each other, and a feeding-side shield member having two principal surfaces that face each other, one of the principal surfaces of the primary magnetic core and one of the principal surfaces of the feeding-side shield member being disposed so as to face each other; and a power receiving unit, the power receiving unit including a receiving-side coil having a secondary winding and a secondary magnetic core, the secondary magnetic core having two principal surfaces that face each other, and a receiving-side shield member that has two principal surfaces that face each other, one of the principal surfaces of the secondary magnetic core and one of the principal surfaces of the receiving-side shield member being disposed so as to face each other, the receiving-side coil and the receiving-side shield member being disposed so as to overlap each other. The power feeding unit and the power receiving unit are disposed so that another one of the principal surfaces of the primary magnetic core and another one of the principal surfaces of the secondary magnetic core face each other across the primary winding and the secondary winding. The distance from a surface of the feeding-side shield member which faces the feeding-side coil to a surface of the feeding-side coil which faces the feeding-side shield member, is longer than the distance from a surface of the receiving-side shield member which faces the receiving-side coil to a surface of the receiving-side coil which faces the receiving-side shield member.

According to the present invention, the distance from a surface of the feeding-side shield member which faces the feeding-side coil to a surface of the feeding-side coil which faces the feeding-side shield member is longer than the distance from a surface of the receiving-side shield member which faces the receiving-side coil to a surface of the receiving-side coil which faces the receiving-side shield member. As a result, the Q factor in the power feeding unit improves. Since power transmission efficiency is the product of a coupling coefficient k and a Q factor, the Q factor is an important factor for improving power transmission efficiency. Therefore, an improvement in Q factor leads to an improvement in power transmission efficiency. Further, because the receiving-side coil and the receiving-side shield member are disposed so as to overlap each other in the power receiving unit, unnecessary radiation to the surroundings and an electromagnetic influence from the surroundings can be reduced. Therefore, the present invention can provide a wireless power transmission device that makes it possible to achieve both the above-mentioned effect on the feeding side and the above-mentioned effect on the receiving side.

First Embodiment

FIG. 1 is a cross-sectional view of a wireless power transmission device according to a first embodiment of the present invention.

A wireless power transmission device 1 according to the first embodiment includes a power feeding unit 10 and a power receiving unit 20 described below.

(Power Feeding Unit 10)

The power feeding unit 10 includes a feeding-side coil 41, and a feeding-side shield member 51. The feeding-side coil 41 has a primary winding 11, and a primary magnetic core 21 having two principal surfaces 215 and 21S' that face each other. The feeding-side shield member 51 has two principal surfaces 515 and 51S' that face each other. The principal surface 21S' representing one of the principal surfaces of the primary magnetic core 21, and the principal surface 51S representing one of the principal surfaces of the feeding-side shield member 51 are disposed so as to face each other.

The primary winding 11 is a wire that is wound in a planar shape, and provided on the principal surface 21S, which is one of the principal surfaces of the primary magnetic core 21 located opposite to the principal surface 21S' facing the feeding-side shield member 51. The primary winding 11 has two principal surfaces 11S and 11S' that face each other. The principal surfaces 11S and 11S' are substantially parallel to the principal surface 21S of the primary magnetic core 21.

(Power Receiving Unit 20)

The power receiving unit 20 includes a receiving-side coil 42, and a receiving-side shield member 52. The receiving-side coil 42 has a secondary winding 12, and a secondary magnetic core 22 having two principal surfaces 22S and 22S' that face each other. The receiving-side shield member 52 has two principal surfaces 52S and 52S' that face each other. The principal surface 22S representing one of the principal surfaces of the secondary magnetic core 22, and the principal surface 52S representing one of the principal surfaces of the receiving-side shield member 52 are disposed so as to face each other, and the receiving-side coil 42 and the receiving-side shield member 52 are disposed so as to overlap each other.

The secondary winding 12 is a wire that is wound in a planar shape, and provided on the principal surface 22S, which is one of the principal surfaces of the secondary magnetic core 22 located opposite to the principal surface 22S' on which the receiving-side shield member 52 is provided. The secondary winding 12 has two principal surfaces 12S and 12S' that face each other. The principal surfaces 12S and 12S' are substantially parallel to the principal surface 22S of the secondary magnetic core 22.

Because the secondary winding is disposed in this way, the expression "the receiving-side coil 42 and the receiving-side shield member 52 are disposed so as to overlap each other" as used in the first embodiment means that the receiving-side coil 42 and the receiving-side shield member 52 are stacked on top of each other with the principal surface 22S' of the secondary magnetic core 22 and the principal surface 52S of the receiving-side shield member 52 being in contact with each other.

The power feeding unit 10 and the power receiving unit 20 mentioned above are disposed as follows.

The power feeding unit 10 and the power receiving unit 20 are disposed so that the other principal surface 21S of the primary magnetic core 21 and the other principal surface 22S of the secondary magnetic core 22 face each other and are substantially parallel to each other across the primary winding 11 and the secondary winding 12. A distance $\mathbf{1}_1$ from the principal surface 51S of the feeding-side shield member 51 which faces the feeding-side coil 41 to the principal surface 41S' of the feeding-side coil 41 which faces the feeding-side shield member 51, is longer than the distance from the principal surface 52S of the receiving-side shield member 52 which faces the receiving-side coil 42 to the principal surface 42S' of the receiving-side coil 42 which faces the receiving-side shield member 52.

In the first embodiment, because the primary winding is disposed as described above, the expression "the principal surface 51S of the feeding-side shield member 51 which faces the feeding-side coil 41" means the principal surface 51S of the feeding-side shield member 51 which faces the primary magnetic core 21. Further, the expression "the principal surface 41S' of the feeding-side coil 41 which faces the feeding-side shield member 51" means the principal surface 21S' of the primary magnetic core 21 which faces the feeding-side shield member 51.

Further, in the first embodiment, because the secondary winding is disposed as described above, the expression "the principal surface 52S of the receiving-side shield member 52 which faces the receiving-side coil 42" means the principal surface 52S of the receiving-side shield member 52 which faces the secondary magnetic core 22. Further, the expression "the principal surface 42S' of the receiving-side coil 42 which faces the receiving-side shield member 52" means the principal surface 22S' of the secondary magnetic core 22 which faces the receiving-side shield member 52.

The above-mentioned structure of the wireless power transmission device 1 according to the first embodiment ensures that the effect of the present invention is achieved more reliably.

In the first embodiment, examples of the primary winding 11 and the secondary winding 12 include a metal wire made of copper, silver, gold, aluminum, or the like. From the viewpoint of weight reduction, it is preferable to use an aluminum wire, a copper-clad aluminum wire, or the like. From the viewpoint of achieving both weight reduction and high electrical conductivity, a copper-clad aluminum wire obtained by uniformly coating an aluminum wire with copper is preferred. The copper-clad aluminum wire is preferable used as a Litz wire made up of a large number of wires twisted in a bundle. The same kind of metal wire or different kinds of metal wire may be used for the primary winding 11 and the secondary winding 12.

While the primary winding 11 and the secondary winding 12 are not particularly limited as long as these windings are wires that are wound in a planar shape, these windings are preferably shaped so as to have an opening at the center. The outer shape of the primary and secondary windings 11 and 12 is not particularly limited, either. Examples of this outer shape include a quadrangular shape, a circular shape, an elliptical shape, and a polygonal shape.

The primary magnetic core 21 and the secondary magnetic core 22 are preferably made of a soft magnetic material from the viewpoints of the ease of achieving desired magnetic properties and the ease of shaping a desired geometry, and it is possible to use a magnetic core formed by shaping soft magnetic powder. Although the soft magnetic material used is not particularly limited, a soft magnetic material with a high magnetic permeability and a high electrical resistance is preferred, examples of which include ferrites such as a manganese-zinc ferrite, a nickel-zinc ferrite, and a copper-zinc ferrite.

The outer shape of the primary magnetic core 21 and the secondary magnetic core 22 is not particularly limited as long as these magnetic cores have two principal surfaces that face each other. These principal surfaces may be in any shape such as a quadrangle, a polygon, a circle, or an ellipse.

As the feeding-side shield member 51 and the receiving-side shield member 52, it is preferable to use a metal plate with a high electrical conductivity. Examples of such a metal plate include an aluminum plate and a copper plate. The outer shape of the feeding-side shield member 51 and the receiving-side shield member 52 is not particularly limited as long as these shield members have two principal surfaces that face each other. These principal surfaces may be in any shape such as a quadrangle, a polygon, a circle, or an ellipse.

Second Embodiment

Figure 2:
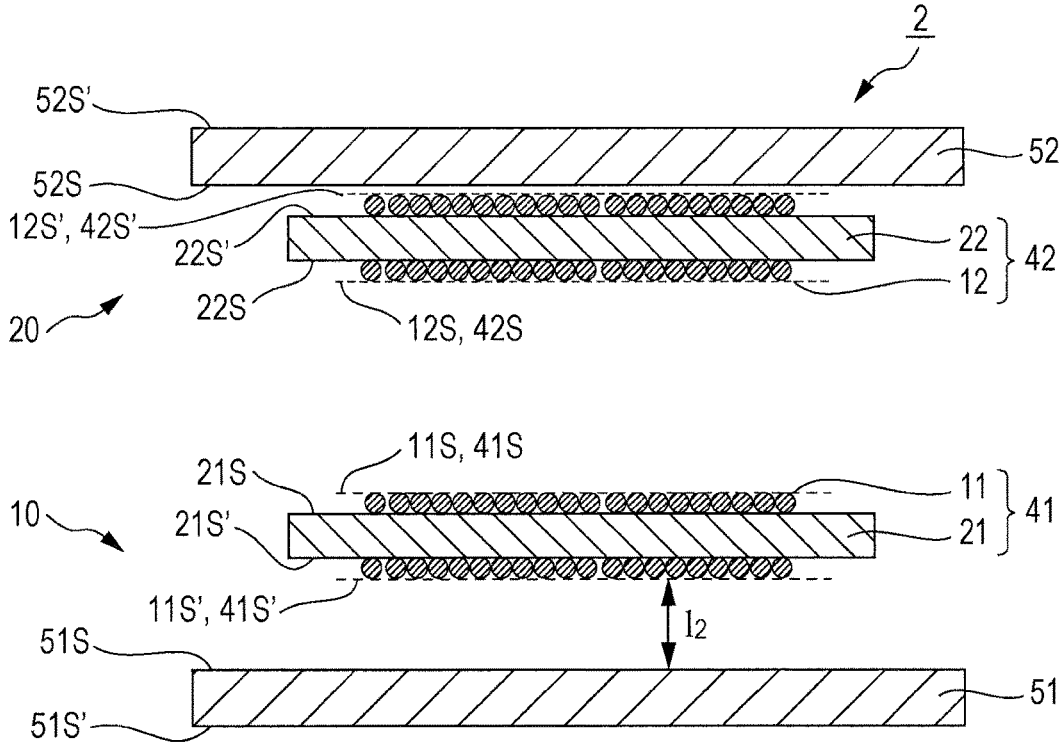
FIG. 2 is a cross-sectional view of a wireless power transmission device according to a second embodiment of the present invention.

FIG. 2 is a cross-sectional view of a wireless power transmission device according to a second embodiment of the present invention.

A wireless power transmission device 2 according to the second embodiment includes a power feeding unit 10 and a power receiving unit 20 described below.

(Power Feeding Unit 10)

The power feeding unit 10 includes a feeding-side coil 41, and a feeding-side shield member 51. The feeding-side coil 41 has a primary winding 11, and a primary magnetic core 21 having two principal surfaces 21S and 21S' that face each other. The feeding-side shield member 51 has two principal surfaces 51S and 51S that face each other. The principal surface 21S' representing one of the principal surfaces of the primary magnetic core 21, and the principal surface 51S representing one of the principal surfaces of the feeding-side shield member 51 are disposed so as to face each other.

The primary winding 11 is a wire that is wound around the primary magnetic core 21 in a helical shape while crossing the two principal surfaces 21S and 21S' of the primary magnetic core 21 a plurality of times.

(Power Receiving Unit 20)

The power receiving unit 20 includes a receiving-side coil 42, and a receiving-side shield member 52. The receiving-side coil 42 has a secondary winding 12, and a secondary magnetic core 22 having two principal surfaces 22S and 22S' that face each other. The receiving-side shield member 52 has two principal surfaces 52S and 52S' that face each other. The principal surface 22S representing one of the principal surfaces of the secondary magnetic core 22, and the principal surface 52S representing one of the principal surfaces of the receiving-side shield member 52 are disposed so as to face each other, and the receiving-side coil 42 and the receiving-side shield member 52 are disposed so as to overlap each other.

The secondary winding 12 is a wire that is wound around the secondary magnetic core 22 in a helical shape while crossing the two principal surfaces 22S and 22S' of the secondary magnetic core 22 a plurality of times. Because the secondary winding is disposed in this way, the expression "the receiving-side coil 42 and the receiving-side shield member 52 are disposed so as to overlap each other" as used in the second embodiment means that the receiving-side coil 42 and the receiving-side shield member 52 are stacked on top of each other in such a way that an imaginary plane 12S' located closest to the receiving-side shield member 52, and the principal surface 52S of the receiving-side shield member 52 are in contact with each other. The imaginary plane 12S' includes a tangent to the secondary winding 12 extending in the longitudinal direction of the secondary winding 12, and is parallel to the principal surface 52S of the receiving-side shield member 52.

The power feeding unit 10 and the power receiving unit 20 mentioned above are disposed as follows.

The power feeding unit 10 and the power receiving unit 20 are disposed so that the other principal surface 21S of the primary magnetic core 21 and the other principal surface 22S of the secondary magnetic core 22 face each other and are substantially parallel to each other across the primary winding 11 and the secondary winding 12. A distance $\mathbf{1}_2$ from the principal surface 51S of the feeding-side shield member 51 which faces the feeding-side coil 41 to the principal surface 41S' of the feeding-side coil 41 which faces the feeding-side shield member 51, is longer than the distance from the principal surface 52S of the receiving-side shield member 52 which faces the receiving-side coil 42 to the principal surface 42S' of the receiving-side coil 42 which faces the receiving-side shield member 52.

Because the primary winding is disposed as described above, the expression "the principal surface 41S' of the feeding-side coil 41 which faces the feeding-side shield member 51" as used in the second embodiment means an imaginary plane 11S' closest to the feeding-side shield member 51. The imaginary plane 11S' includes a tangent to the primary winding 11 extending in the longitudinal direction of the primary winding 11, and is parallel to the principal surface 51S of the feeding-side shield member 51. Further, because the primary winding is disposed as described above, the expression "the principal surface 51S of the feeding-side shield member 51 which faces the feeding-side coil 41" means the principal surface 51S of the feeding-side shield member 51 which faces the imaginary plane 11S' mentioned above.

Because the secondary winding is disposed as described above, the expression the principal surface 42S' of the receiving-side coil 42 which faces the receiving-side shield member 52" as used in the second embodiment means the imaginary plane 12S' located closest to the receiving-side shield member 52. The imaginary plane 12' includes a tangent to the secondary winding 12 extending in the longitudinal direction of the secondary winding 12, and is parallel to the principal surface 52S of the receiving-side shield member 52. Further, because the secondary winding is disposed as described above, the expression "the principal surface 52S of the receiving-side shield member 52 which faces the receiving-side coil 42" means the principal surface 52S of the receiving-side shield member 52 which faces the imaginary plane 12S' mentioned above.

The above-mentioned structure of the wireless power transmission device 2 according to the second embodiment ensures that the effect of the present invention is achieved more reliably.

In the second embodiment, as the material of the primary winding 11 and the secondary winding 12, the same material as that of the primary winding 11 and the secondary winding 12 according to the first embodiment may be used. The primary winding 11 and the secondary winding 12 are not particularly limited as long as the primary and secondary windings 11 and 12 are wires that are wound around the primary magnetic core 21 and the secondary magnetic core 22 in a helical shape while crossing the two principal surfaces of the primary magnetic core 21 and secondary magnetic core 22 a plurality of times, respectively. The outer shape of the primary winding 11 and the secondary winding 12 is not particularly limited, either. The cross-section of each of the primary winding 11 and the secondary winding 12 taken perpendicularly to the longitudinal direction of the wire wound in a helical shape may have a shape such as a quadrangular shape, a polygonal shape, a circular shape, or an elliptical shape.

The material and outer shape of the primary magnetic core 21 and the secondary magnetic core 22 may be the same as those used in the first embodiment.

The material and outer shape of the feeding-side shield member 51 and the receiving-side shield member 52 may be also the same as those used in the first embodiment.

Figure 3:
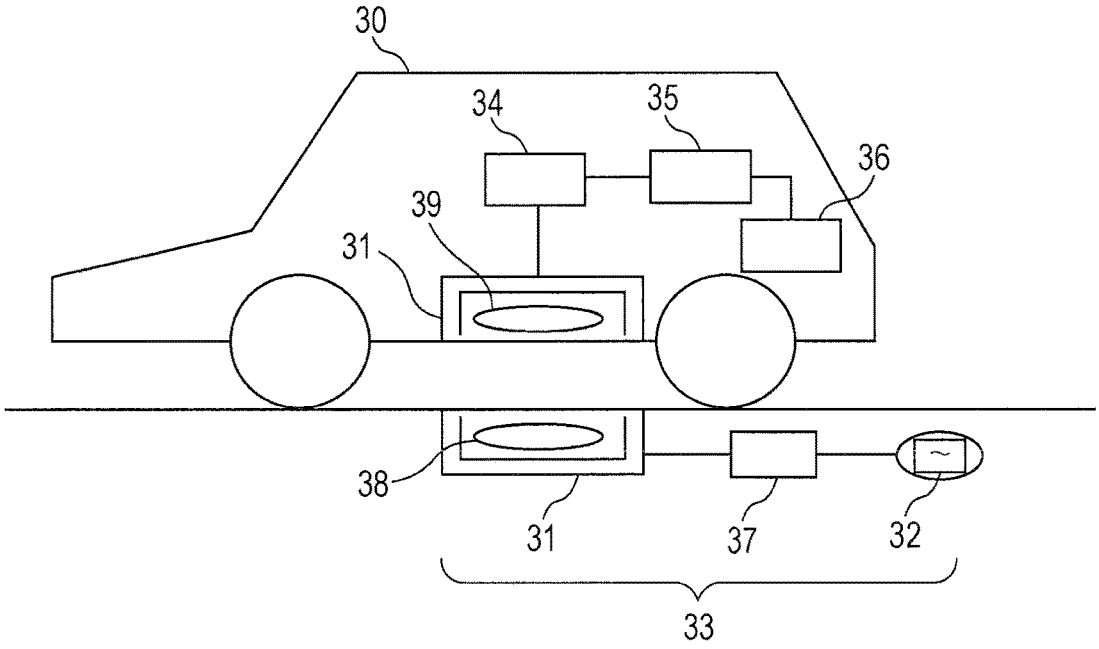
FIG. 3 schematically illustrates a state in which a wireless power transmission device according to the present invention is applied to an electric vehicle.

FIG. 3 is a schematic diagram illustrating a state in which the wireless power transmission device according to the present invention is applied to a power feeding device for an electric vehicle. An electric vehicle 30 is equipped with a coil unit 31 including a power receiving coil 39, and a battery 36 connected to the coil unit 31 via a rectifier 34 and a DC/DC converter 35. The coil unit 31 including the power receiving coil 39 corresponds to the power receiving unit 20 according to the present invention.

A power feeding device 33 disposed in a lower part of the electric vehicle 30 is equipped with the coil unit 31 including a power transmitting coil 38, and an alternating-current power supply 32 connected to the coil unit 31 via a high frequency power driver 37. The coil unit 31 including the power transmitting coil 38 corresponds to the power feeding unit 10 according to the present invention.

The power receiving coil 39 is a coil with open (unconnected) ends. The power receiving coil 39 receives electric power from the power transmitting coil 38 of the power feeding device 33 via an electromagnetic field.

By applying the power receiving unit and the power feeding unit according to the present invention to a wireless power transmission device in which electric power is delivered from the power transmitting coil 38 to the power receiving coil 39, it is possible to provide a wireless power transmission device for an electric vehicle which provides excellent power transmission efficiency and with which unnecessary radiation to the surroundings and an electromagnetic influence from the surroundings are reduced.

In the wireless power transmission device according to the present invention, the receiving-side coil is used in an electric vehicle. However, the receiving-side coil can be applied to a variety of products including other movable bodies such as electric trains, household appliances, electronic equipment, wireless communication equipment, and toys.

EXAMPLE

Hereinafter, the present invention will be described in more detail by way of an example. However, the present invention is not limited to the example described below.

<Preparation of Power Feeding Unit and Power Receiving Unit>

A power feeding unit was prepared by using a feeding-side coil and a feeding-side shield member described below. Further, a power receiving unit was prepared by using a receiving-side coil and a receiving-side shield member described below.

(Power Feeding Unit)

Feeding-side coil: a planar winding (primary winding) having a length of 35 cm, a width of 35 cm, and a thickness of 5 mm was bonded to one principal surface of a ferrite plate (primary magnetic core) having a length of 40 cm, a width of 40 cm, and a thickness of 2 mm.

Feeding-side shield member: an aluminum plate having a length of 40 cm, a width of 40 cm, and a thickness of 2 mm was used.

(Power Receiving Unit)

Receiving-side coil: a planar winding (secondary winding) having a length of 20 cm, a width of 20 cm, and a thickness of 5 mm was bonded to one principal surface of a ferrite plate (secondary magnetic core) having a length of 25 cm, a width of 25 cm, and a thickness of 2 mm.

Receiving-side shield member: an aluminum plate having a length of 25 cm, a width of 25 cm, and a thickness of 2 mm was used.

<Measurement of Q Factor>

The inductance ($L_{TX}$) and the Q factor ($Q_{TX}$) of the feeding-side coil were measured by the following method. First, the feeding-side coil and the receiving-side coil were disposed so that the planar secondary winding of the receiving-side coil faces the planar primary winding of the feeding-side coil as illustrated in FIG. 1. The feeding-side coil and the receiving-side coil were positioned substantially in parallel to each other, and the distance from the principal surface 11S of the planar primary winding of the feeding-side coil to the principal surface 12S of the planar secondary winding of the receiving-side coil was set to 10 cm.

Next, the feeding-side shield member was disposed so that one of its principal surfaces is positioned at varying distances of 0 cm, 1 cm, 2 cm, 3 cm, 4 cm, and 5 cm from one of the two principal surfaces of the primary magnetic core which is located opposite to the principal surface on which the planar primary winding is provided (that is, the distance from the surface of the feeding-side shield member which faces the feeding-side coil (primary magnetic core) to the surface of the feeding-side coil (primary magnetic core) which faces the feeding-side shield member: 0 cm, 1 cm, 2 cm, 3 cm, 4 cm, or 5 cm).

The receiving-side shield member was disposed so that one of its principal surfaces is in contact with one of the two principal surfaces of the secondary magnetic core which is located opposite to the principal surface on which the planar winding is provided (that is, the distance from the surface of the receiving-side shield member which faces the receiving-side coil (secondary magnetic core) to the surface of the receiving-side coil (secondary magnetic core) which faces the receiving-side shield member: 0 cm).

Either end of the primary winding of the feeding-side coil is connected with an LCR meter (manufactured by Agilent Technologies, Inc., product name: 4294A PRECISION IMPEDANCE ANALYZER), and the opposite ends of the secondary winding of the receiving-side coil are brought into contact with each other. The inductance $L_{TX}$ and $Q_{TX}$ of the feeding-side coil were measured while varying the distance between the receiving-side shield member and the receiving-side coil as described above. In the measurement, an alternating current at a frequency f=85 kHz was applied. Between $L_{TX}$ and $Q_{TX}$, the relationship represented by Equation (1) below holds between the frequency f of the alternating current applied during the measurement, and the resistance $r_{TX}$ of the winding of the feeding-side coil.

$$Q_{TX}=2\pi f L_{TX} r_{TX} \quad (1)$$

Figure 4:
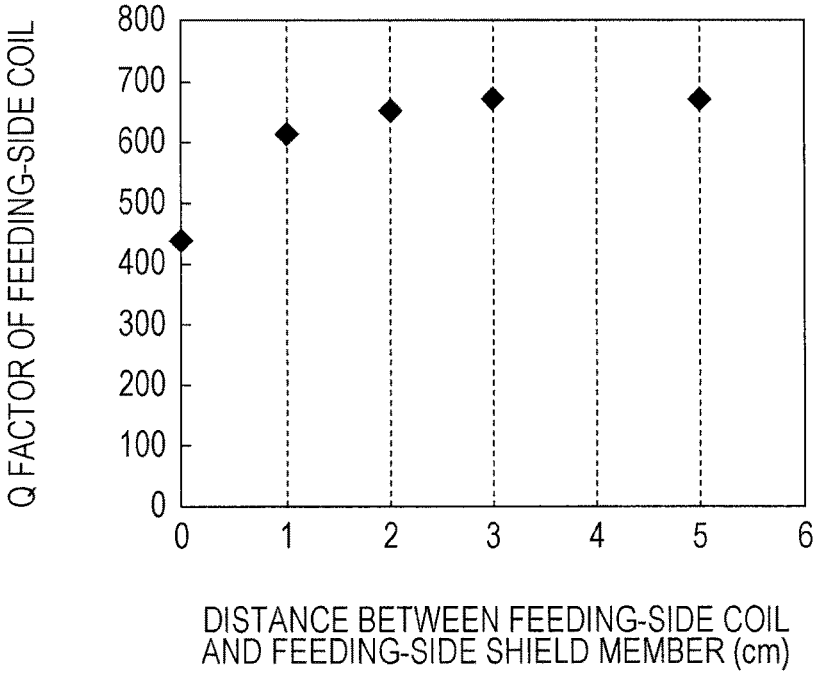
FIG. 4 is a graph illustrating the relationship between the distance from a surface of a feeding-side shield member which faces a feeding-side coil to a surface of the feeding-side coil which faces the feeding-side shield member, and the Q factor ($Q_{TX}$) of the feeding-side coil, which is measured by using a wireless power transmission device according to an example of the present invention.

The relationship between the distance from the surface of the feeding-side shield member which faces the feeding-side coil (primary magnetic core) to the surface of the feeding-side coil (primary magnetic core) which faces the feeding-side shield member (horizontal axis), and the Q factor ($Q_{TX}$, vertical axis) of the feeding-side coil obtained as described above is illustrated in FIG. 4. When the distance from the surface of the feeding-side shield member which faces the feeding-side coil (primary magnetic core) to the surface of the feeding-side coil (primary magnetic core) which faces the feeding-side shield member was varied from 0 cm to 5 cm, the Q factor of the feeding-side coil increased sharply as the distance was varied from 0 cm to 1 cm, the Q factor increased gradually as the distance was varied from 1 cm to 2 cm, and the Q factor increased slightly as the distance was varied from 2 cm to 5 cm. These results reveal that the Q factor ($Q_{TX}$) of the feeding-side coil can be improved when the receiving-side coil and the receiving-side shield member are disposed so as to overlap each other, and the distance, from the surface of the feeding-side shield member which faces the feeding-side coil to the surface of the feeding-side coil which faces the feeding-side shield member is made longer than the distance from the surface of the receiving-side shield member which faces the receiving-side coil to the surface of the receiving-side coil which faces the receiving-side shield member.

What is claimed is:

1. A wireless power transmission device, comprising:

a power feeding unit, the power feeding unit including a feeding-side coil having a primary winding and a primary magnetic core, the primary magnetic core having two principal surfaces that face each other, and a feeding-side shield member having two principal surfaces that face each other, one of the principal surfaces of the primary magnetic core and one of the principal surfaces of the feeding-side shield member being disposed so as to face each other; and a power receiving unit, the power receiving unit including a receiving-side coil having a secondary winding and a secondary magnetic core, the secondary magnetic core having two principal surfaces that face each other, and a receiving-side shield member that has two principal surfaces that face each other, one of the principal surfaces of the secondary magnetic core and one of the principal surfaces of the receiving-side shield member being disposed so as to face each other, the receiving-side coil and the receiving-side shield member being disposed so as to overlap each other, wherein the power feeding unit and the power receiving unit are disposed so that another one of the principal surfaces of the primary magnetic core and another one of the principal surfaces of the secondary magnetic core face each other across the primary winding and the secondary winding, and wherein a distance from a surface of the feeding-side shield member which faces the feeding-side coil to a surface of the feeding-side coil which faces the feeding-side shield member, is longer than a distance from a surface of the receiving-side shield member which faces the receiving-side coil to a surface of the receiving-side coil which faces the receiving-side shield member.

2. The wireless power transmission device according to claim 1, wherein:

the primary winding is a wire that is wound in a planar shape, and provided on one of the principal surfaces of the primary magnetic core which is located opposite to one of the principal surfaces of the primary magnetic core which faces the feeding-side shield member; and the secondary winding is a wire that is wound in a planar shape, and provided on one of the principal surfaces of the secondary magnetic core which is located opposite to one of the principal surfaces of the secondary magnetic core which faces the receiving-side shield member.

3. The wireless power transmission device according to claim 1, wherein:

the primary winding is a wire that is wound around the primary magnetic core in a helical shape while crossing the two principal surfaces of the primary magnetic core a plurality of times; and the secondary winding is a wire that is wound around the secondary magnetic core in a helical shape while crossing the two principal surfaces of the secondary magnetic core a plurality of times.

* * * * *